US007083525B2

(12) United States Patent
Pond et al.

(10) Patent No.: US 7,083,525 B2
(45) Date of Patent: Aug. 1, 2006

(54) GOLF CLUB HEAD WITH INSERT

(75) Inventors: Brian Pond, San Marcos, CA (US); Andre Shmoldas, Carlsbad, CA (US); Tom Morris, Carlsbad, CA (US); Jim McGeeney, Poway, CA (US)

(73) Assignee: Roger Cleveland Golf Company, Inc., Huntington Beach, CA (US)

( * ) Notice: Subject to any disclaimer, the term of this patent is extended or adjusted under 35 U.S.C. 154(b) by 319 days.

(21) Appl. No.: 10/016,179

(22) Filed: Oct. 30, 2001

(65) Prior Publication Data

US 2003/0083150 A1 May 1, 2003

(51) Int. Cl.
*A63B 53/04* (2006.01)
*A63B 69/36* (2006.01)

(52) U.S. Cl. ..... 473/251; 473/252; 473/253; 473/340; 473/341; 473/350; 473/334; 473/349; 473/342; 273/DIG. 14

(58) Field of Classification Search ..... 473/250, 473/251, 252, 253, 254, 324, 334, 335, 336, 473/337, 338, 339, 340, 341, 342, 345, 349, 473/350, 290, 291, 305; 273/DIG. 14
See application file for complete search history.

(56) References Cited

U.S. PATENT DOCUMENTS 1,449,559 A * 3/1923 Relle ..... 473/342
3,134,595 A * 5/1964 Boznos ..... 473/250
3,749,408 A * 7/1973 Mills ..... 473/336
3,815,910 A * 6/1974 Raines ..... 473/31
3,815,941 A * 6/1974 Snyder ..... 285/283
3,995,857 A * 12/1976 Cochran et al. ..... 473/291
4,121,832 A * 10/1978 Ebbing ..... 473/335
4,355,808 A * 10/1982 Jernigan et al. ..... 473/324
4,390,184 A * 6/1983 Rudell ..... 473/253
4,444,395 A * 4/1984 Reiss ..... 473/335
4,749,196 A * 6/1988 Podgor ..... 473/250
4,979,744 A * 12/1990 Alcala ..... 473/341
4,999,000 A * 3/1991 Finney ..... 473/341
5,078,398 A * 1/1992 Reed et al. ..... 473/313
5,308,067 A * 5/1994 Cook ..... 473/341
5,346,213 A * 9/1994 Yamada ..... 473/329
5,385,348 A * 1/1995 Wargo ..... 473/338
5,531,444 A * 7/1996 Buettner ..... 473/349
5,643,111 A 7/1997 Igarashi
5,674,132 A 10/1997 Fisher
5,800,282 A 9/1998 Hutin et al.
5,846,140 A * 12/1998 Hoburg ..... 473/240
5,935,015 A * 8/1999 Spiegel ..... 473/226
5,938,543 A 8/1999 McGeeney et al.
6,077,171 A * 6/2000 Yoneyama ..... 473/291
6,086,484 A * 7/2000 Uebelhor ..... 473/251
6,106,410 A * 8/2000 Glod et al. ..... 473/290
6,196,936 B1 3/2001 Meckel
6,206,790 B1 * 3/2001 Kubica et al. ..... 473/335

(Continued)

*Primary Examiner*—Sebastiano Passaniti
(74) *Attorney, Agent, or Firm*—Steptoe & Johnson LLP

(57) ABSTRACT

A golf club head comprising an integral toe, heel and center section, with the center section including a cavity. The center section is structured so that the majority of the weight of the golf club head is positioned at the toe and heel. One embodiment of the golf club head includes an insert located in the cavity and a second insert is located in the golf ball striking face of the golf club head. The inserts, alone and in combination, increase the feel transmitted through the golf club head to the golfer.

37 Claims, 8 Drawing Sheets

U.S. PATENT DOCUMENTS

| | | | | |
|---|---|---|---|---|
| 6,273,831 | B1 | 8/2001 | Dewanjee | |
| 6,273,832 | B1 | 8/2001 | Helmstetter et al. | |
| 6,290,609 | B1 * | 9/2001 | Takeda | 473/335 |
| 6,328,662 | B1 * | 12/2001 | Huang | 473/334 |
| 6,422,950 | B1 * | 7/2002 | Whitlam | 473/313 |
| 6,450,894 | B1 * | 9/2002 | Sun et al. | 473/252 |
| 6,458,044 | B1 * | 10/2002 | Vincent et al. | 473/334 |
| 6,699,142 | B1 * | 3/2004 | Wu | 473/340 |
| 2003/0139226 | A1 * | 7/2003 | Cheng et al. | 473/334 |

* cited by examiner

FIG. 3
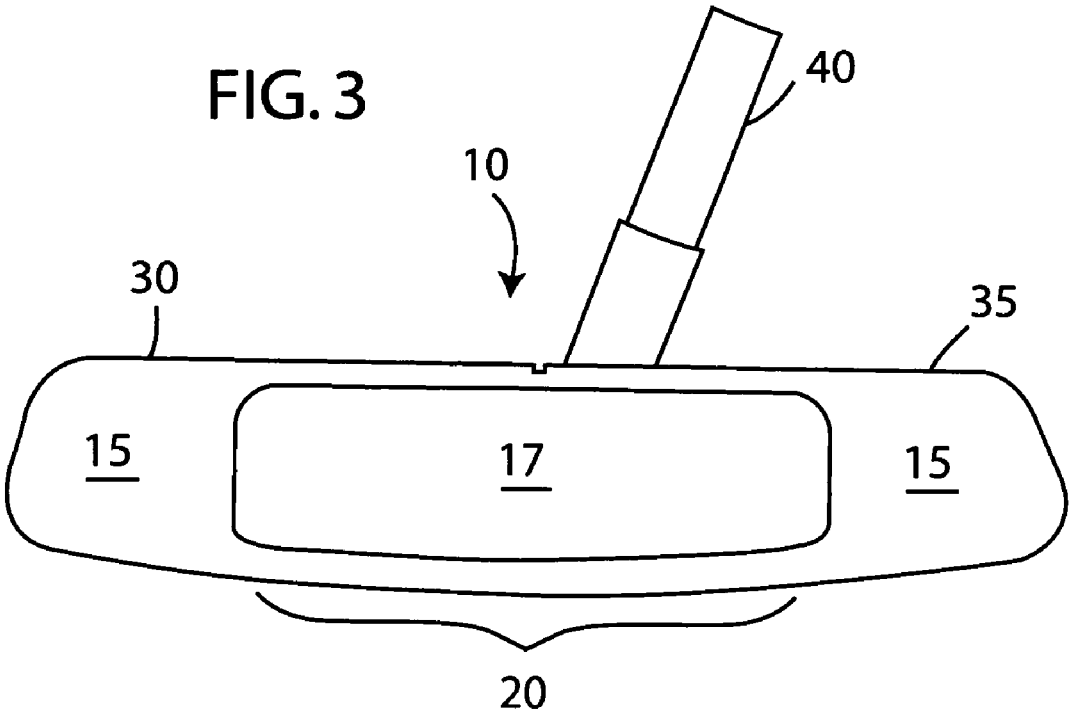
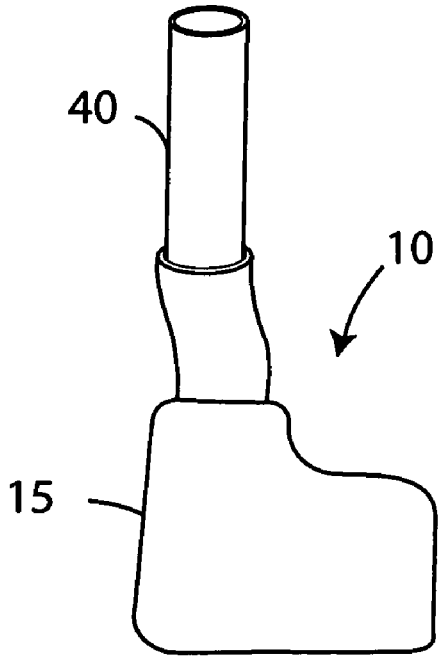
FIG. 4

GOLF CLUB HEAD WITH INSERT

FIELD OF THE INVENTION

The present invention generally relates to golf clubs. More particularly, the invention concerns a golf club head that includes an inset.

BACKGROUND OF THE INVENTION

Golf is a sport that is enjoyed throughout the world. Golfers use a variety of golf clubs to hit a ball into a hole or pin. Depending upon the individual course or hole, the golfer may be required to hit the ball several hundred yards. The golfer will first use a wood-type golf club, then a iron club, and finally a putter once he or she is on the green.

Slight mistakes on the part of the golfer can result in the ball being hit out of play, or simply not in the desired direction. Golf balls are small, hard balls, designed to maximize travel distance. The drawback to hard golf balls is that they impart very little "feel" to the golfer when he strikes the ball with the golf club. The "feel" that a golfer senses when he strikes the ball imparts information that, in part, enables the golfer to improve his or her golfing skill. Golf club "feel" is a combination of several factors, some of which are the vibration that travels up the golf club shaft from the golf club head and the sound that is made when the golf club hits the golf ball. The "feel" transmits important information to the golfer including whether the golf ball was struck with the correct area of the golf club head.

When a golf ball is struck with the wrong part of the golf club head, the golf ball generally does not travel in the direction desired. Preferably, the ball-striking face of the golf club will have a large "sweet spot," which will direct the ball in the desired direction. To achieve this golf club head characteristic, golf clubs have been constructed with high polar moments of inertia.

The polar moment of inertia of an object is a measure of how easily the object rotates about an axis of rotation. Objects with a large polar moment of inertia will be harder to rotate than objects with a small polar moment of inertia. The force of a golf ball striking a golf club head will create a torque about the golf club shaft. A golf club head constructed with a large polar moment of inertia will resist the torque force more than a golf club head having a small polar moment of inertia. The resistance to the torque force results in the golf ball going in the desired direction even when the golf ball is struck outside the "sweet spot."

A high polar moment of inertia is achieved by adjusting the weight distribution across the club head. Various weighting techniques have been employed to increase the polar moment of inertia, thereby increasing the "sweet spot." Such techniques often involve either perimeter weighting in which the weight is distributed to the perimeter areas of the club away from the center of the club head, or heel-toe weighting in which materials having different densities are used in the heel, toe and center portions of the club head in order to distribute more weight in the heel and toe of the golf club. However, golf clubs that have a high polar moment of inertia generally have little or no "feel."

Therefore, there exists a need for a golf club head that combines a high polar moment of inertia with an optimum "feel" that imparts information and confidence to a golfer.

SUMMARY OF THE INVENTION

In order to overcome the deficiencies with known, conventional golf club heads, a golf club head with an insert is provided. Briefly, one embodiment of the invention provides a golf club head that includes a toe section, a heel section and a center section joining the toe section to the heel section, with the center section including a cavity for receiving an insert. A face insert is also coupled to the strike face of the golf club head.

A golf club head constructed according to the invention is inexpensive to manufacture, and provides a high polar moment of inertia while also transmitting a superior "feel" to the golfer.

BRIEF DESCRIPTION OF THE DRAWINGS

FIG. 3 is a front elevation view of the striking face of the embodiment illustrated in FIG. 1;

FIG. 4 is a heel-end elevation view of the embodiment illustrated in FIG. 1;

It will be recognized that some or all of the Figures are schematic representations for purposes of illustration and do not necessarily depict the actual relative sizes or locations of the elements shown.

DETAILED DESCRIPTION OF THE INVENTION

In the following paragraphs, the present invention will be described in detail by way of example with reference to the attached drawings. Throughout this description, the preferred embodiment and examples shown should be considered as exemplars, rather than as limitations on the present invention. As used herein, "the present invention" refers to any one of the embodiments or equivalents of the invention described herein.

The golf club head constructed according to the present invention has a high polar moment of inertia and also transmits a superior "feel" to the golfer. Unlike conventional high polar moment of inertia golf club heads, the golf club head of the present invention is constructed of a single piece of material which decreases manufacturing costs. A high-polar moment of inertia is achieved by constructing a center section of the club head with thin-walled sections. The thin-walled sections join the toe and heel sections that are substantially solid and contain a majority of the mass of the club head. The "feel" of the club head can be adjusted by positioning inserts of different characteristics into a cavity located in the center section. In one embodiment, a structural insert is placed in the cavity, increasing the stiffness of the golf club head, thereby affecting the "feel" of the golf club. Another embodiment places a vibration damper in the cavity with the insert, which again affects the "feel" of the golf club.

Figure 1:
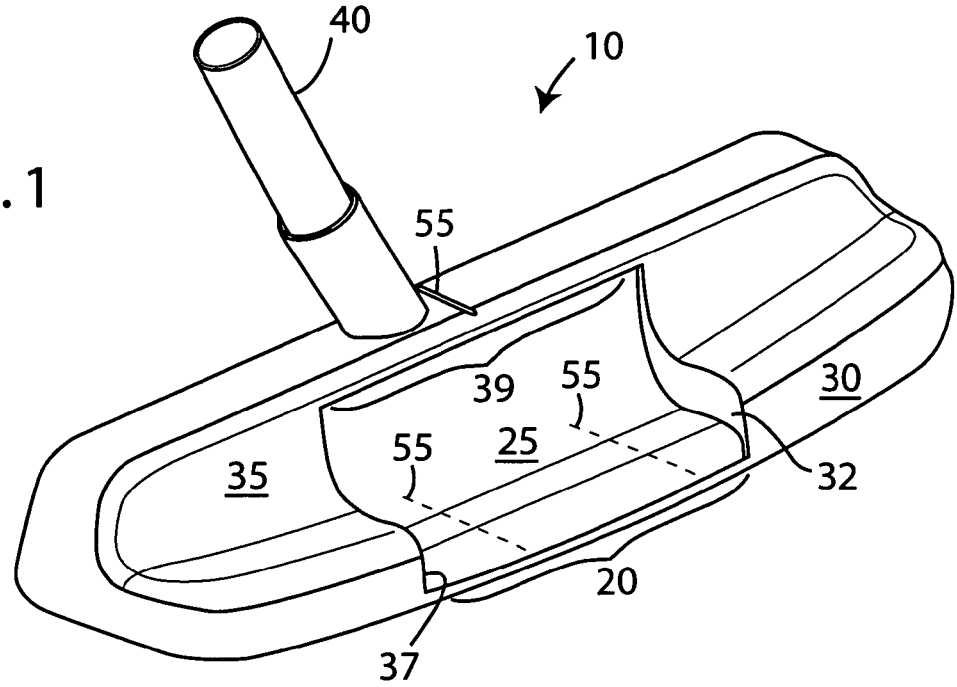
FIG. 1 is perspective view of one embodiment of the invention illustrating an insert positioned in the golf club head.
Figure 2:
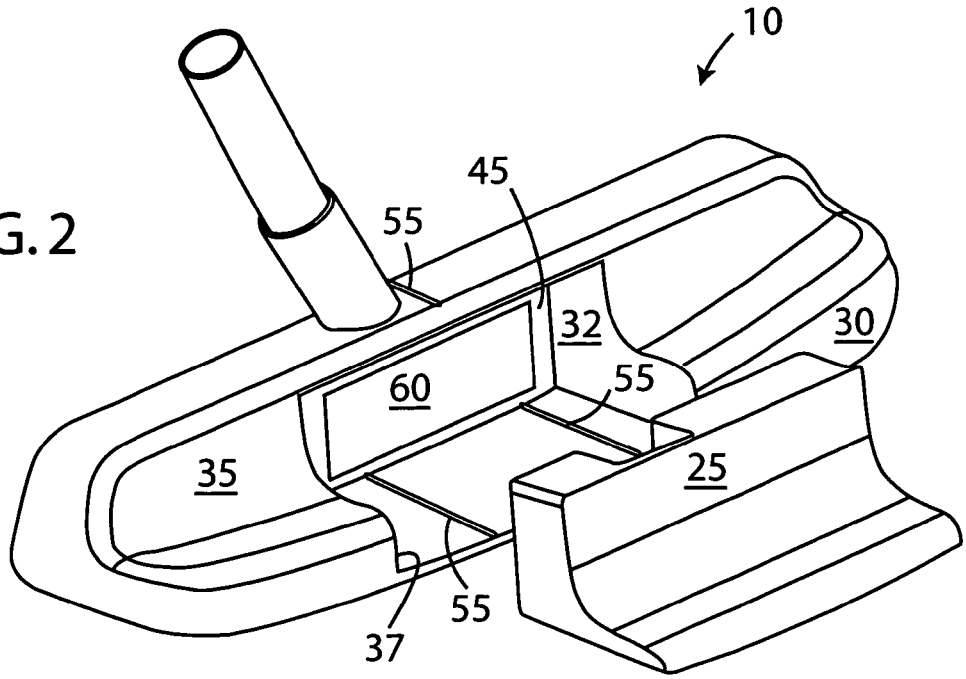
FIG. 2 is a perspective view of the embodiment illustrated in FIG. 1, with the insert positioned adjacent to the golf club head.

Referring to FIGS. 1–2, the golf club head 10 has a toe section 30, a heel section 35 and a center section 20. The center section 20 joins the toe section 30 to the heel section 35. As shown in FIG. 2, the center section 20 is somewhat pocket-shaped and includes a rear face 45, a rear floor 50, a toe wall 32, a heel wall 37 and a roof section 39. The center section 20 is constructed so that the toe 30 and heel 35 comprise at least 80% of a weight of the golf club head 10. In a preferred embodiment, the toe 30 and heel 35 comprise about 90% of the weight of the golf club head 10.

The thickness of the rear face section 45, rear floor 50, and roof section 39 have a thickness that can range between 0.020 inch and 0.20 inch. Because the enter section 20 is constructed of thin walls, the majority of the mass of the golf club head 10 is located in the toe section 30 and heel section 35. One feature of the present invention is that the golf clue head 10 is constructed of a single piece of material which decreases manufacturing costs. Preferably, the golf club head 10 is manufactured by a casting or molding method.

Figure 5:
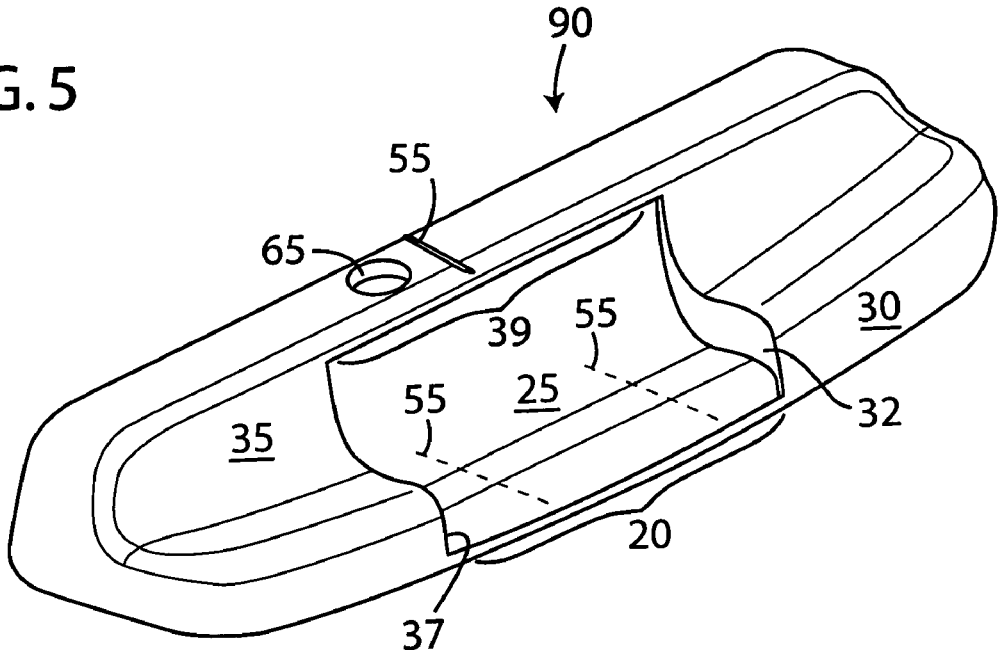
FIG. 5 is a perspective view of another embodiment of the present invention that includes a cavity for placement of a hosel.
Figure 6:
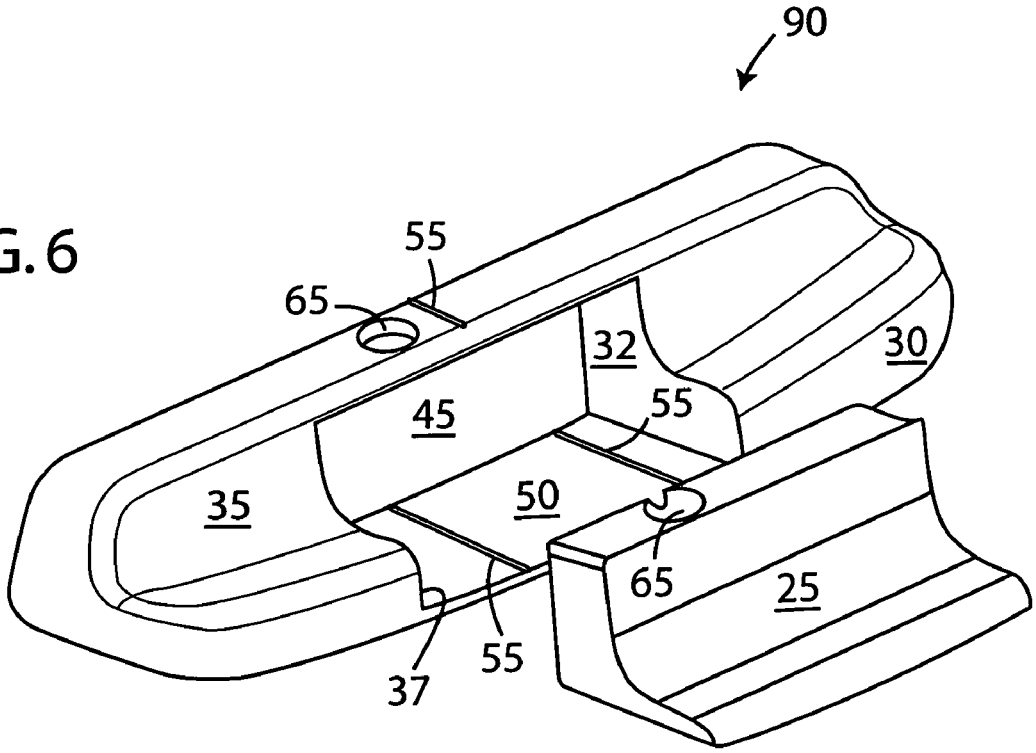
FIG. 6 is a perspective view of the embodiment illustrated in FIG. 5, showing the insert adjacent to the golf club head.
Figure 7:
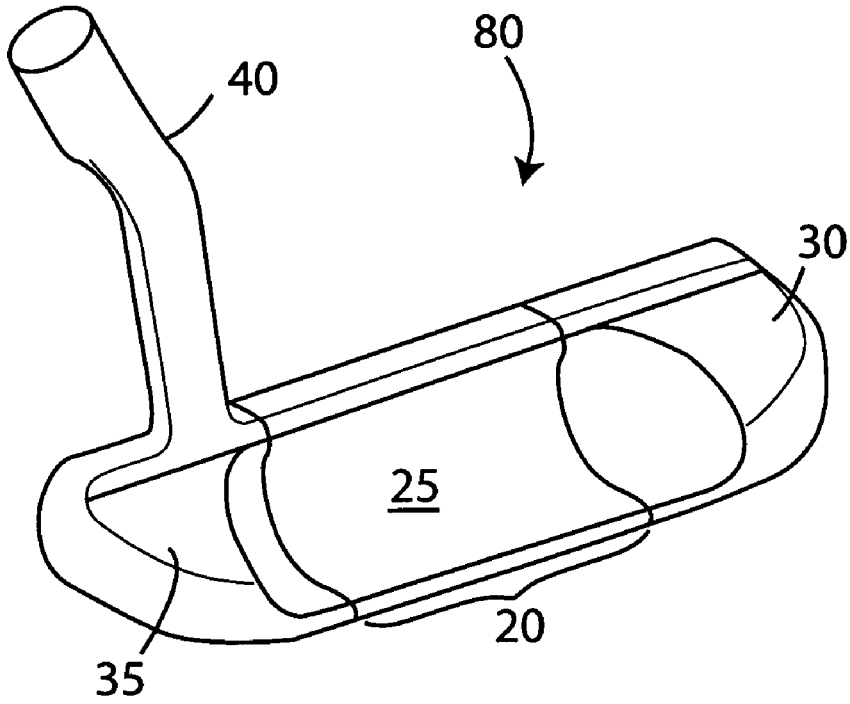
FIG. 7 is yet another embodiment of the present invention, showing a hosel mounted in the heel-end of the golf club.
Figure 8:
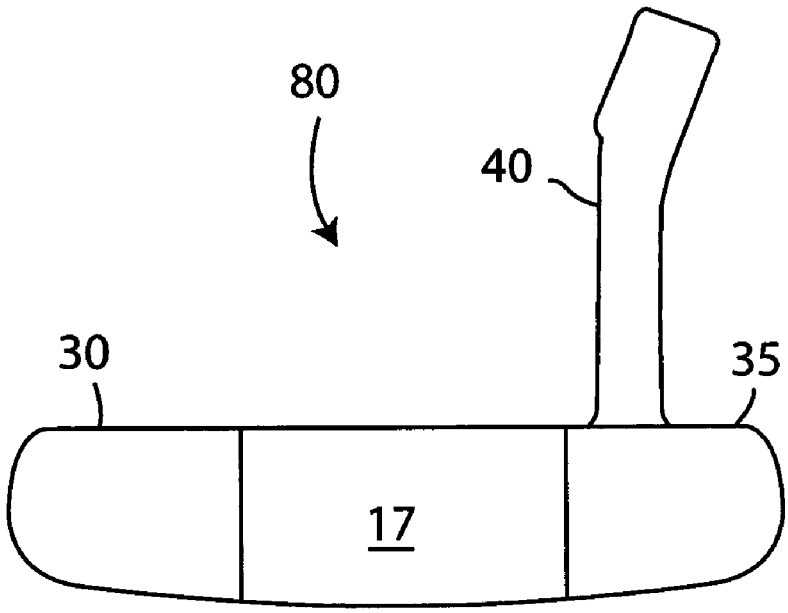
FIG. 8 is a front elevation view of the embodiment illustrated in FIG. 7 showing the striking face of the golf club head.
Figure 9:
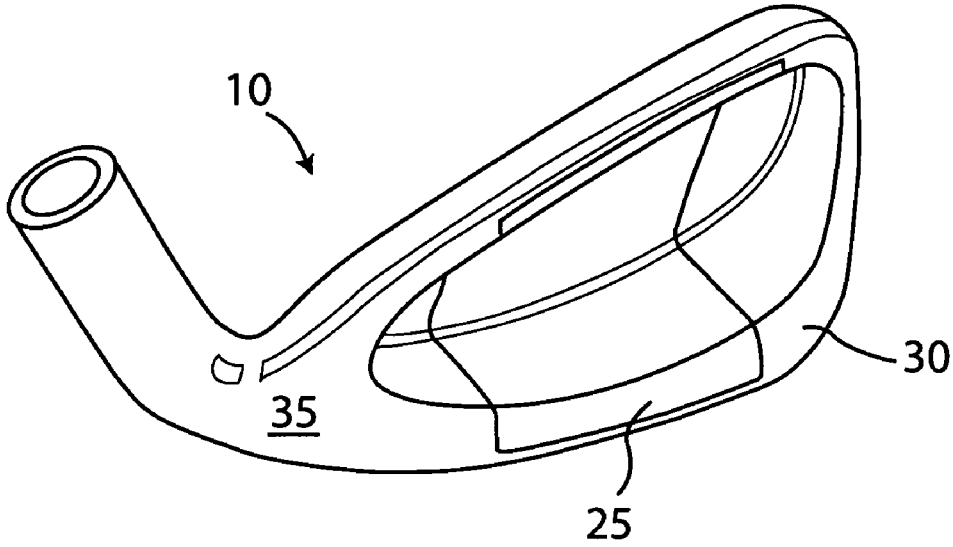
FIG. 9 is a perspective view of another embodiment of the present invention showing an insert positioned in a metal head.
Figure 10:
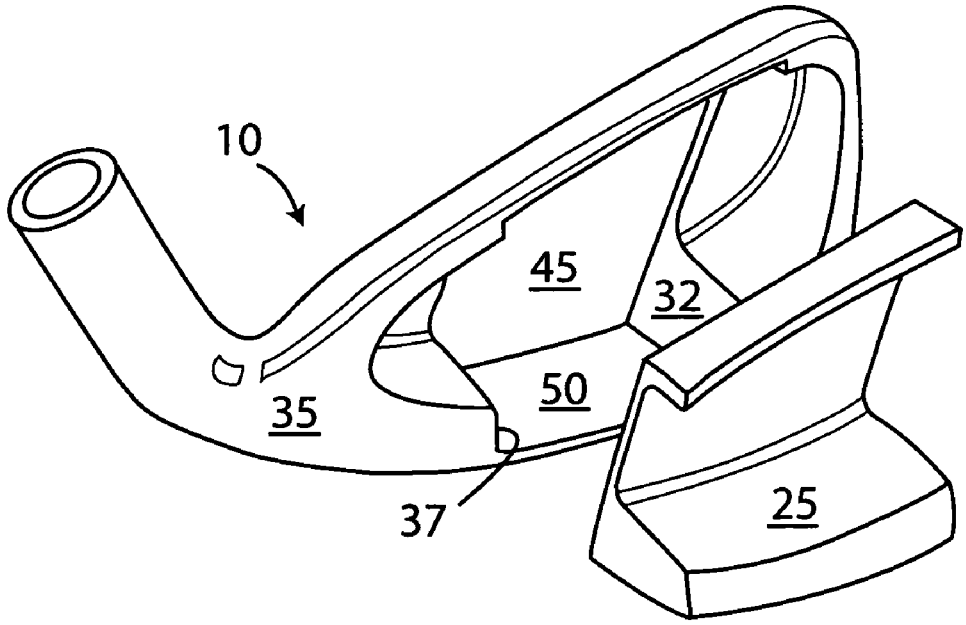
FIG. 10 is a perspective view of the embodiment shown in FIG. 9 with the insert positioned adjacent to the metal head.
Figure 12:
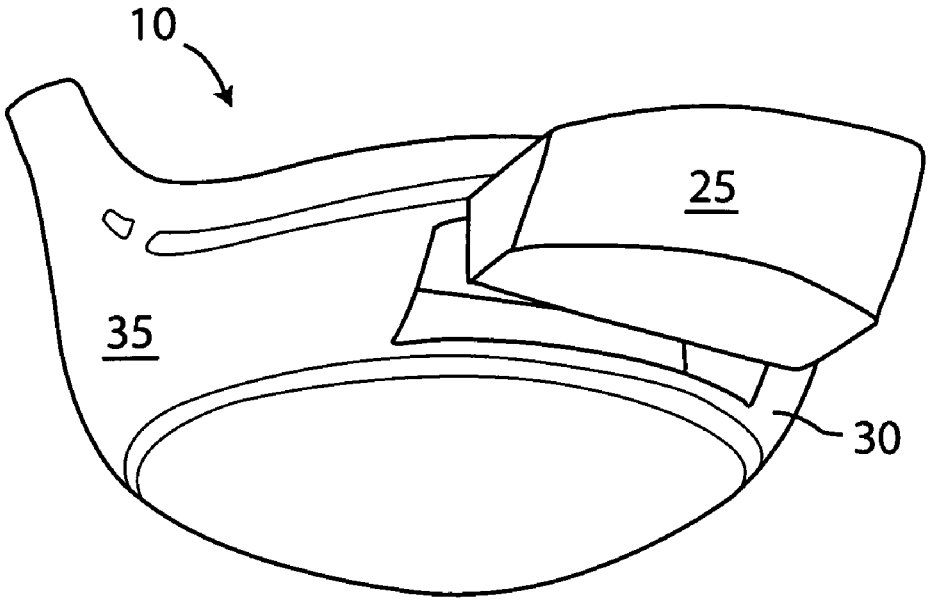
FIG. 12 is a perspective view of the embodiment shown in FIG. 11 with the insert positioned adjacent to the wood head.
Figure 11:
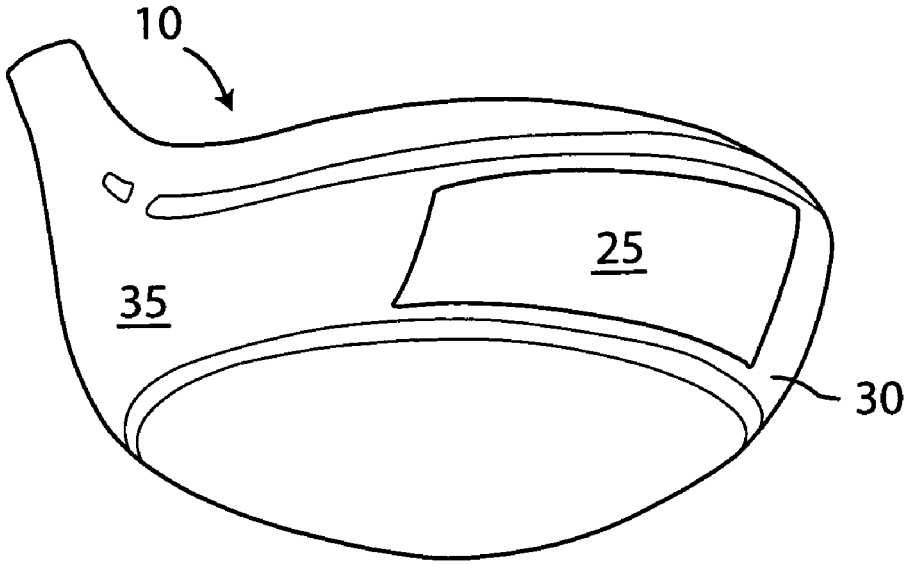
FIG. 11 is a perspective view of another embodiment of the present invention showing an insert positioned in a wood head.
Figure 13:
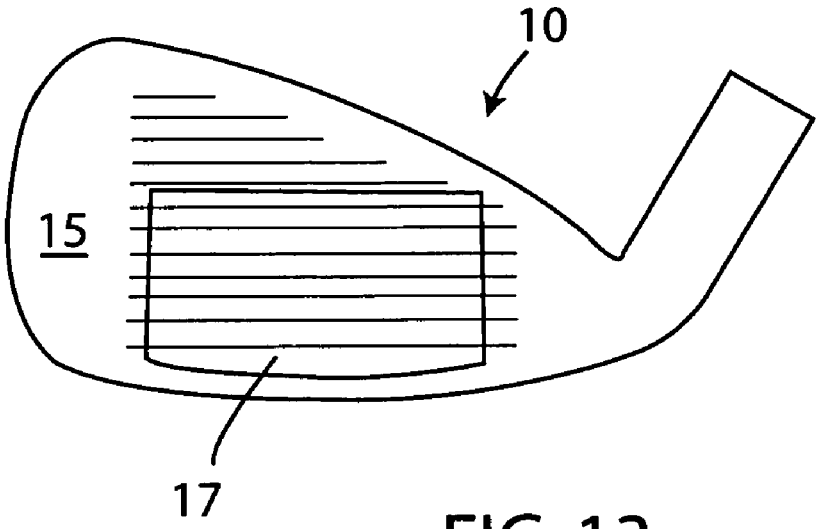
FIG. 13 is an elevation showing a face insert located in a metal head.
Figure 14:
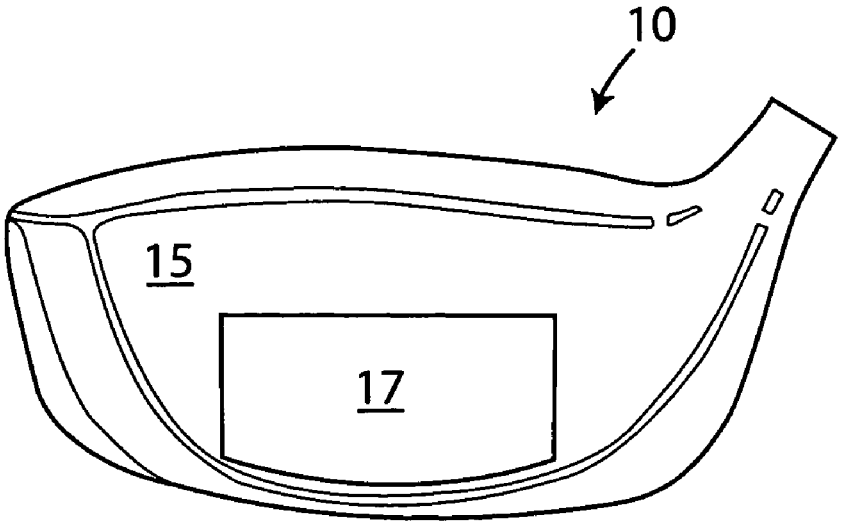
FIG. 14 is an elevation showing a face insert located in a wood head.

A cast golf club head constructed according to the present invention may include a hosel 40, illustrated in FIGS. 1–4 and 7–8. The hosel 40 provides a mounting point for the golf club shaft (not shown). The hosel 40 shown in FIGS. 1–4 projects from the center section 20. FIGS. 7–8 illustrate an alternative embodiment golf club head 80 that includes hosel 40 projecting from the heel section 35. Different golfers have different preferences for the hosel 40 location. Yet another embodiment golf club head 90, illustrated in FIGS. 5–6, does not include a hosel 40. In this embodiment, the golf club shaft is mounted directly into aperture 65 in the golf club head 90, and in the insert 25.

With the exception of inclusion of the hosel 40, and the different hosel 40 locations described above, the features and characteristics described with reference to golf club head 10 may be attributed to both golf club head 80 and 90.

The golf club head 10 is comprised of a metallic material including at least one metal, and preferably is comprised of a metallic material including at least two metals. The metallic materials should each have a final alloy density of at least 7 grams per cubic centimeter. In a more preferred version of the invention, the metallic materials each have a final alloy density of 7 to 13 grams per cubic centimeter. In a still more preferred version of the invention, the metallic materials each have a final alloy density of 9 to 11 grams per cubic centimeter. In a most preferred version of the invention, the metallic materials each have a final alloy density of approximately 10 grams per cubic centimeter.

The golf club head 10 may also comprise a metallic material wherein a first metal is dispersed in a second metal. The dispersion of the first metal in the second metal is advantageously achieved by powder metallurgy techniques wherein a powder of the first metal is blended with a powder of a second metal and the resulting powder metal blend is compacted and sintered at temperatures below the melting point of both metals. The first metal should have a higher density than the second metal. The addition of a high density first metal to a lower density second metal allows the final alloy density of the metallic material of the golf club head to be increased in precision increments. In specific embodiments of the invention, the first metal has a density of at least 10 grams per cubic centimeter, and the second metal is selected from the group consisting of iron based alloys, nickel based alloys, and copper based alloys. Specific examples of a suitable first metal include tugsten, tantalum, niobium, and molybdenum. In one embodiment of the invention, the metallic material has a finally alloy density of at least 10 grams per cubic centimeter and the metallic material has a final alloy density at least 8 times greater than the density of nonmetallic material, when present.

The non-metallic materials used informing the golf club head 10 produce a final product wherein the non-metallic material has a substantially homogeneous composition.

One feature of the present invention is that the center section 20 contains an insert 25 that increases the stiffness of the golf club head 10. Illustrated in FIGS. 2 and 6, the thin walls of the center section, including the rear face 45, rear floor 50, and roof section 39 are reinforced by the insert 25. The present invention displaces the center weight to the toe section 30 and heel section 35 and replaces the center weight with a low-density insert 25. In addition to increasing the rigidity of the golf club head, the insert 25 also enhances the "feel" of the golf club head 10.

Every golf club has its own individual "feel." Golf club "feel" is what a golfer senses when he strikes a golf ball with a golf club. "Feel" is a combination of several factors including the vibration that travels up the handle of the golf club to the golfer's hands and noise from the club when it contacts the golf ball. A well-tuned golf club imparts a "feel" to the golfer that inspires confidence and allows a golfer to modulate his swing based on the "feel" that he receives from the club. One feature is that a golf club bead 10 constructed according to the present invention imparts an optimum "feel" to the golfer while also having a high polar moment of inertia.

As discussed above, the high polar moment of inertia is achieved by positioning a majority of the mass of the golf club head 10 at the toe section 30 and heel section 35. The walls comprising the center section 20 are very thin, including the rear face 45, illustrated in FIGS. 2 and 6. As shown in FIGS. 3 and 4, opposite the rear face 45 is the front face or striking face 15. In use, a golf ball strikes the front face 15. Preferably, the golf ball strikes the center section 20 of the front face 15. As discussed above, the thickness of the rear face 45, and thus the thickness of the front face 15 in the center section 20 can range between about 0.020 and 0.20 inch. When a golf ball strikes the thin-walled center section 20 a bell-like sound is transmitted to the golfer. One feature of the present invention is that the bell-like sound generated by the thin-walled center section 20 can be tuned to create an optimum "feel". This is not possible with other types of golf club heads that do not have a thin-walled center section. A variety of components and devices can be placed in the pocket formed by the thin-walled center section 20 to tune the "feel" of the golf club as desired.

One embodiment of the golf club head 10 constructed according to the present invention may be tuned to have a "feel" that is suitable for a golfer just learning how to play golf. A club for a beginner is tuned to have a softer, more forgiving "feel." Another embodiment of the golf club head 10 constructed according to the present invention may be tuned to impart a "feel" that suits a more experienced golfer. The experienced golfer's club is tuned to have a stiffer "feel."

One method of tuning the golf club heads is to position an insert 25 into the center section 20. Illustrated in FIGS. 1–2, 5–6 and 7, the insert 25 performs a variety of functions. One type of insert 25, increases the structural strength of the golf club heads, thereby changing the natural frequency of the golf club head 10 and thereby changing the sound generated when a golf ball is struck by the face 15. This is because the frequency that a struck object vibrates with is known as the natural frequency of the object. The natural frequency will change with a change in the stiffness of an object.

In one embodiment, the insert 25 reduces the bell-like sound generated by the thin-walled center section 20. Changing the stiffness of the golf club head 10 also changes the "feel" of the golf club 10 by changing the sound generated when the golf club 10 strikes a golf ball and the vibration that is transmitted to the golfer's hands. Preferably the insert 25 is constructed of a polycarbonate such as LEXAN, but other materials such graphite epoxy, aluminum, or other suitable materials can be employed (LEXAN is a registered trademark of General Electric Co., of Schenectady, N.Y.). An alternative embodiment insert 25 may be constructed using powder metalurgy methods, such as a silicone carbide reinforced metal matrix composite.

In a preferred embodiment the insert 25 is substantially transparent so that the rear face 45, rear floor 50, toe wall 32, heel wall 37 and roof section 39 can be viewed through the insert 25. Preferably the insert weighs about 12 grams but can range between 5 and 30 grams.

In a preferred embodiment golf club head 10, illustrated in FIGS. 1–2, floor sight lines 55 are located on the rear floor 50 of the center section 20. The sight lines are used by a golfer to position the golf club head 10 relative to a golf ball. A substantially transparent insert 25 is positioned as shown in FIG. 1 in the center section 20 so that the sight lines are visible through the insert 25. Another sight line is located on the roof section 39 of the golf club head 10. As used herein, transparent or substantially transparent refers to a material characteristic that allows the passage of a sufficient amount of light to allow a person to look through the material and observe an object or structural feature.

Referring to FIG. 2, a dampener 60 may be placed on the rear face 45 of the golf club 10. The dampener 60 provides vibration dampening which changes both the sound generated when the golf club 10 strikes a golf ball and the vibration transmitted up the golf club shaft to the player's hands. The dampener 60 provides yet another way to construct a golf club head 10 to change the "feel" perceived by a golfer when striking a golf ball.

In one embodiment the dampener 60 can be deposited onto the golf club head 10 as a fluid and allowed to cure. A preferred embodiment dampener 60 comprises an adhesive strip of material that is attached to the rear face 45 of the golf club head 10. The insert 25 is then attached to the dampener 60. This preferred embodiment employs a viscoelastic dampening polymer manufactured by 3M (3M is a registered trademark of Minnesota Mining & Manufacturing Co. of St. Paul, Minn.). Another dampener 60 that may be employed is an acrylic polymer, but it will be appreciated that other types of dampeners may be employed. Preferably the dampener 60 has a thickness than can range between 0.002 and 0.020 inch.

Referring to FIGS. 3 and 8, a face insert 17 may be placed on the front face 15 of the golf club 10. The face insert 17 is located in the area of the golf club head 10 that is designed to strike the golf ball. The face insert 17 affects the "feel" transmitted to the golfer when a golf ball is struck. This is because the face insert 17 is softer than the metal golf club head 10, and provides a softer impact with the golf ball, improving the "feel."

Conventional face inserts are constructed of thermoset polyurethanes. Thermoset polyurethanes are generally manufactured by mixing a polyurethane and a curing agent. The mixture is cast into a sheet-like shape, and then individual parts are stamped out of the sheet. The curing agents are volatile and demand careful handling procedures, and the manufacturing process requires several steps. In addition, thermoset polyurethanes have a relatively high rebound.

A face insert 17 constructed according to the present invention is constructed of a thermoplastic polyurethane. Thermoplastic polyurethanes do not require curing agents and need only be heated and injected into a manufacturing mold. An alternative embodiment face insert 17 may be constructed of a blend of polyurethane and silicone. Preferably, the face insert 17 has a Bayshore rebound between 30 and 60. A preferred embodiment face insert 17 has a Bayshore rebound of about 45. The Bayshore rebound number of a measure of the resilience of a material. The determination of rebound resilience is accomplished by dropping a plunger of a specific mass and geometry from a predetermined height onto the surface of a test specimen and measuring the distance that the plunger rebounds after contact. A ratio of the rebound distance to the distance traveled by the mass prior to contacting the test specimen is then calculated. This ratio is referred to as the Bayshore rebound number. Therefore, a lower Bayshore rebound number reflects a material resilience that is less springy, or bouncy. A face insert 17 having a lower Bayshore rebound number may be used in a golf club head 10 for a professional golfer who plays on a "fast green" where a golf ball can travel effortlessly after only a small impact.

Referring to FIGS. 3 and 8, the insert 17 may comprise about 45 to 75% of the total area of the front face 15. In a preferred embodiment, the insert 17 comprises about 50% of the front face 15.

One embodiment of the present invention golf club head 10 is protected by a coating. The coating is preferably applied using a physical vapor deposition source such as a cathodic arc source, and a surrounding atmosphere of a nonmetal. Other techniques such as magnetron sputtering may also be used. The coating comprises at least one layer of a coating material such as vanadium, chromium, zirconium, titanium, niobium, molybdenum, hafnium, tantalum, and tungsten, and a nonmetal such as nitrogen and carbon. A preferred embodiment golf club head 10 is coated with a titanium carbo-nitride material, but other materials such as chromium carbo-nitride may be employed.

The characteristics and features of golf club heads 10, 80 and 90, described above, may be incorporated into wood-type, iron-type or putter-type golf club heads.

Thus, it is seen that a golf club head including an insert is provided. One skilled in the art will appreciate that the present invention can be practiced by other than the preferred embodiments, which are presented in this description for purposes of illustration and not of limitation, and the present invention is limited only by the claims that follow. It is noted that various equivalents for the particular embodiments discussed in this description may practice the invention as well.

What is claimed is:

1. A golf club head comprising:

a toe section;

a heel section;

a strike face;

a substantially transparent rear-insert; and a center section joining the toe section to the heel section, the center section having a floor, and a cavity therein for receiving the rear-insert; and the toe section, heel section and center section are a single piece, and the toe section and heel sections together comprise at least 80% of the weight of the club head.

2. The golf club head of claim 1, wherein the toe section and heel section together comprise at least 90% of the weight of the club head.

3. The golf club head of claim 1, wherein the cavity is defined by a back wall, the floor, two side walls and a roof, with the roof, back wall and floor each having a thickness between 0.020 and 0.20 inch.

4. The golf club head of claim 1, wherein the insert is for increasing a natural frequency of the golf club head.

5. The golf club head of claim 1, wherein the rear-insert is coupled to a back face of the golf club head, the back face located opposite the strike face, and the insert is for dampening a vibration generated in the strike face when a golf ball contacts the strike face.

6. The golf club head of claim 1, wherein the rear-insert weighs between 5 and 30 grams.

7. The golf club head of claim 1, wherein the rear-insert weighs about 12 grams.

8. The golf club head of claim 1, wherein the rear-insert comprises a material selected from the group consisting of: polycarbonate, graphite, aluminum and graphite epoxy.

9. The golf club head of claim 1, wherein the rear-insert is made by a powder metallurgy process.

10. The golf club head of claim 1, further comprising a hosel positioned in the rear-insert.

11. The golf club of claim 1, further comprising a vapor deposited coating covering at least the toe and heel of the.

12. The golf club head of claim 11, wherein the vapor deposited coating is comprised of a material selected from the group consisting of: titanium carbo-nitride, chromium carbo-nitride, vanadium, chromium, zirconium, titanium, niobium, molybdenum, hafnium, tantalum, and tungsten, nitrogen and carbon.

13. The golf club head of claim 1, wherein the club head is selected from the group consisting of: wood-type club heads, iron-type club heads, and putter-type club heads.

14. The golf club head of claim 1, further comprising a dampener connecting the rear-insert in the cavity.

15. The golf club head of claim 14, wherein the dampener is selected from the group consisting of: viscoelastic polymers and acrylic polymers.

16. The golf club head of claim 14, wherein the dampener has a thickness between 0.002 and 0.020 inch.

17. The golf club head of claim 14, wherein the dampener is for changing a sound emitted by the golf club head when a golf ball is struck.

18. A golf club head comprising:

a toe section;

a heel section;

a rear-cavity insert; and a center section joining the toe section to the heel section, the center section having a floor, and a cavity therein for receiving said insert, which rear-insert is substantially transparent and positioned adjacent to the floor of the golf club head, with the floor including a sight line for positioning the golf club head relative to a golf ball, with the sight line visible through the rear-insert.

19. A golf club head including a strike face for hitting a golf ball, the golf club head comprising:

a toe section;

a heel section;

a substantially transparent rear-insert;

a center section joining the toe section to the heel section, the center section having a floor, and a cavity therein for receiving the rear-insert; and face-insert coupled to the strike face.

20. The golf club head of claim 19, wherein the face-insert comprises a material selected from the group consisting of: thermoplastic polyurethanes, and a blend of polyurethane and silicone.

21. The golf club head of claim 19, wherein the face-insert comprises about 50% of the area of the strike face.

22. The golf club head of claim 19, wherein the face-insert comprises between about 45 and 75% of the area of the strike face.

23. The golf club head of claim 19, wherein face-insert has a Bayshore rebound between 30 and 60.

24. The golf club head of claim 19, wherein the toe section, heel section and center section are a single piece, and the toe section and heel section together comprise at least 80% of the weight of the club head.

25. The golf club head of claim 19, wherein the rear-insert is for increasing a natural frequency of the golf club head.

26. The golf club head of claim 19, wherein the rear-insert is coupled to a back face of the golf club head, with the back face located opposite the strike face, and the face-insert is for dampening a vibration generated in the strike face when a golf ball contacts the strike face.

27. The golf club head of claim 19, further comprising a golf club shaft positioned in the rear-insert.

28. The golf club head of claim 19, further comprising a vapor deposited coating covering at least the toe and heel of the golf club head.

29. The golf club head of claim 19, wherein the club head is selected from the group consisting of: wood-type club heads, iron-type club heads, and putter-type club heads.

30. The golf club head of claim 19, further comprising a dampener connecting the rear-insert in the cavity.

31. A golf club head comprising:

a toe section;

a heel section;

a strike face;

a rear-insert; and a center section joining the toe section to the heel section, the center section having a floor, and a cavity therein for receiving said rear-insert, which rear-insert is substantially transparent, and positioned adjacent to the floor of the golf club head, with the floor including a sight line for positioning the golf club head relative to a golf ball, with the sight line visible through the rear-insert.

32. A golf club head comprising:

a toe section;

a heel section;

a center section joining the toe section to the heel section, wherein the toe section and heel section comprise at least 80% of the weight of the club head, the center section having a floor, and a cavity therein for receiving a rear-insert; and a substantially transparent insert positioned in the cavity and adjacent to the floor, with the floor including a sight line for positioning the golf club head relative to a golf ball, with the sight line visible through the insert.

33. The golf club head of claim 32, wherein the insert is for increasing a natural frequency of the golf club head.

34. The golf club head of claim 32, further comprising a vapor deposited coating covering at least the toe section and heel section of the golf club head.

35. The golf club head of claim 32, further comprising a dampener connecting the insert to the cavity.

36. The golf club head of claim 35, wherein the dampener is for changing a sound emitted by the golf club head when a golf ball is struck.

37. The golf club head of claim 32, wherein the club head is selected from the group consisting of: wood-type club heads, iron-type club heads, and putter-type club heads.

* * * * *